US011608626B2

(12) United States Patent
Kim et al.

(10) Patent No.: US 11,608,626 B2
(45) Date of Patent: Mar. 21, 2023

(54) PREFABRICATED POST ASSEMBLY

(71) Applicants: Seung Il Kim, Paju-si (KR); Hyung Ho Lim, Goyang-si (KR)

(72) Inventors: Seung Il Kim, Paju-si (KR); Hyung Ho Lim, Goyang-si (KR)

( * ) Notice: Subject to any disclaimer, the term of this patent is extended or adjusted under 35 U.S.C. 154(b) by 0 days.

(21) Appl. No.: 17/792,194

(22) PCT Filed: Feb. 8, 2021

(86) PCT No.: PCT/KR2021/001610
§ 371 (c)(1),
(2) Date: Jul. 12, 2022

(87) PCT Pub. No.: WO2021/167281
PCT Pub. Date: Aug. 26, 2021

(65) Prior Publication Data

US 2023/0041026 A1 Feb. 9, 2023

(30) Foreign Application Priority Data

Feb. 21, 2020 (KR) ..... 10-2020-0021349

(51) Int. Cl.
*E04B 1/24* (2006.01)

(52) U.S. Cl.
CPC .... *E04B 1/2403* (2013.01); *E04B 2001/2409* (2013.01); *E04B 2001/2415* (2013.01); *E04B 2001/2421* (2013.01); *E04B 2001/2451* (2013.01)

(58) Field of Classification Search
CPC ..... E04B 1/2403; E04B 2001/2409; E04B 2001/2415; E04B 2001/2421; E04B 2001/2451; E04H 17/1447; E04H 17/1448; E04H 17/1452; E04H 17/1486; E04H 17/1488; F16B 2200/20; F16B 2200/205
See application file for complete search history.

(56) References Cited

U.S. PATENT DOCUMENTS 3,498,654 A * 3/1970 Diaz ..... F16B 12/00 403/231
6,138,427 A * 10/2000 Houghton ..... E04B 1/2403 52/655.1
6,390,719 B1 * 5/2002 Chan ..... F16B 7/185 52/646
6,694,700 B1 * 2/2004 Mackett ..... E04B 1/30 411/404

(Continued)

FOREIGN PATENT DOCUMENTS

CN 201722826 1/2011
KR 10-1697743 1/2017

(Continued)

*Primary Examiner* — Brian E Glessner
*Assistant Examiner* — Adam G Barlow
(74) *Attorney, Agent, or Firm* — Lex IP Meister, PLLC

(57) ABSTRACT

A prefabricated post assembly is proposed. The prefabricated post assembly includes a vertical post having at least one assembly surface and a horizontal post having an assembly module mounted at an end thereof to be coupled to the assembly surface, in which at least one upper insertion hole is formed at an upper portion of the assembly surface and at least one lower insertion hole is formed at a lower portion of the assembly surface.

6 Claims, 8 Drawing Sheets

(56) References Cited

U.S. PATENT DOCUMENTS

| | | | | |
|---|---|---|---|---|
| 7,637,076 | B2 * | 12/2009 | Vaughn | E04C 3/32 403/217 |
| 8,689,516 | B2 * | 4/2014 | Richardson | B62D 27/026 52/655.1 |
| 9,458,619 | B2 * | 10/2016 | Bowron | E04B 1/2403 |
| 10,179,991 | B2 * | 1/2019 | Houghton | E04H 9/021 |
| 10,206,506 | B1 * | 2/2019 | Lai | A47B 96/1433 |
| 10,368,639 | B1 * | 8/2019 | Lai | A47B 95/00 |
| 10,626,594 | B2 * | 4/2020 | Yu | E04B 1/5812 |
| 10,634,473 | B2 * | 4/2020 | Travis | F42B 15/36 |
| 10,907,342 | B1 * | 2/2021 | Parkhouse | F16B 7/0413 |
| 10,907,343 | B1 * | 2/2021 | Mou | E04C 3/36 |
| 10,961,696 | B2 * | 3/2021 | Mou | E04H 9/0237 |
| D927,965 | S * | 8/2021 | Bowron | D8/354 |
| D929,209 | S * | 8/2021 | Bowron | D8/354 |
| 11,098,476 | B2 * | 8/2021 | Jin | E04B 1/2403 |
| 2010/0205891 | A1 * | 8/2010 | Bong | E04B 1/2403 52/655.1 |
| 2013/0306808 | A1 * | 11/2013 | Huang | A47B 13/06 248/163.1 |
| 2014/0325932 | A1 * | 11/2014 | Tran | E04C 5/162 52/700 |
| 2015/0021534 | A1 * | 1/2015 | Molina | E04F 11/1817 29/428 |
| 2018/0094419 | A1 * | 4/2018 | Houghton | E04B 1/1903 |

FOREIGN PATENT DOCUMENTS

| | | |
|---|---|---|
| KR | 10-1733987 | 5/2017 |
| KR | 2017-0108547 | 9/2017 |

* cited by examiner

[Fig. 1]
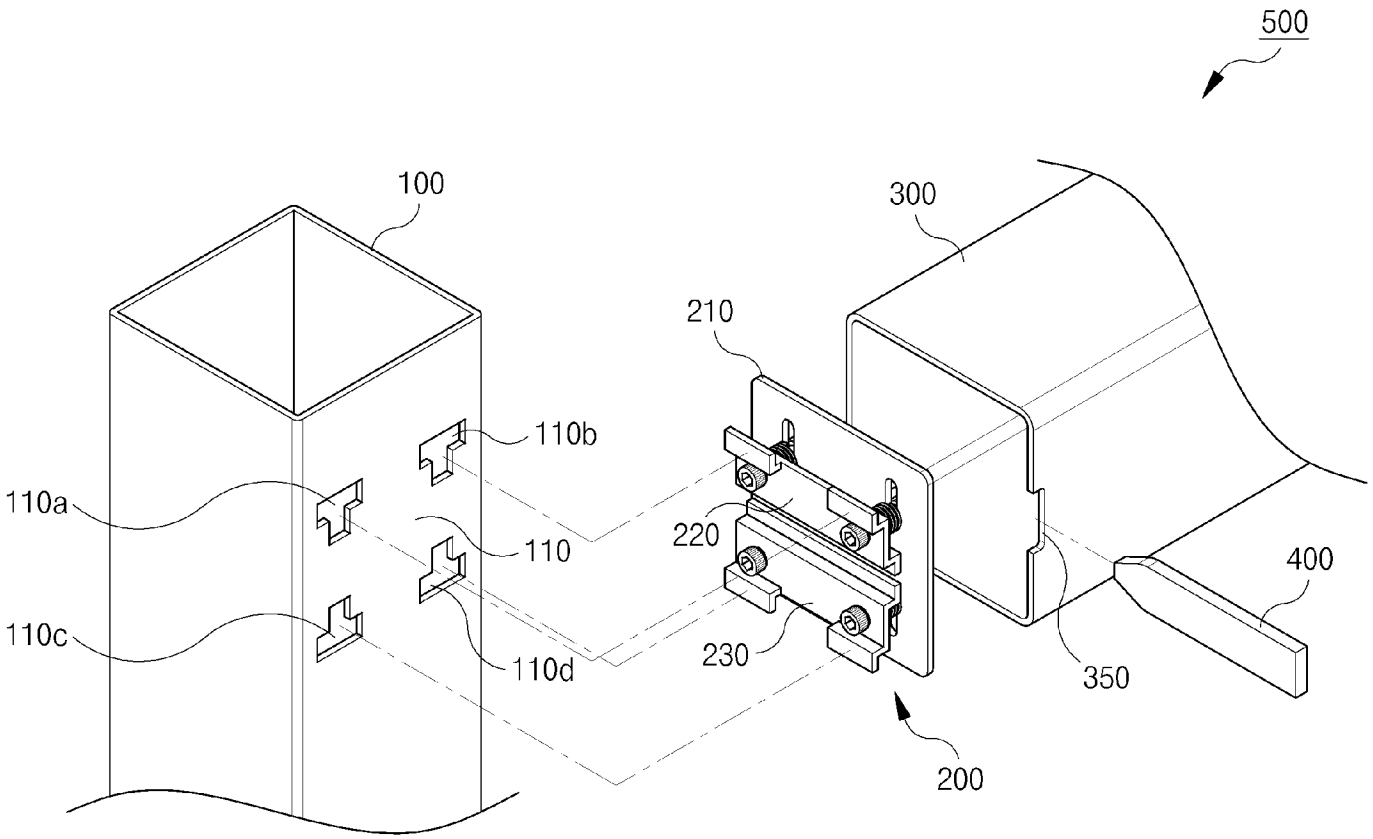

[Fig. 2]
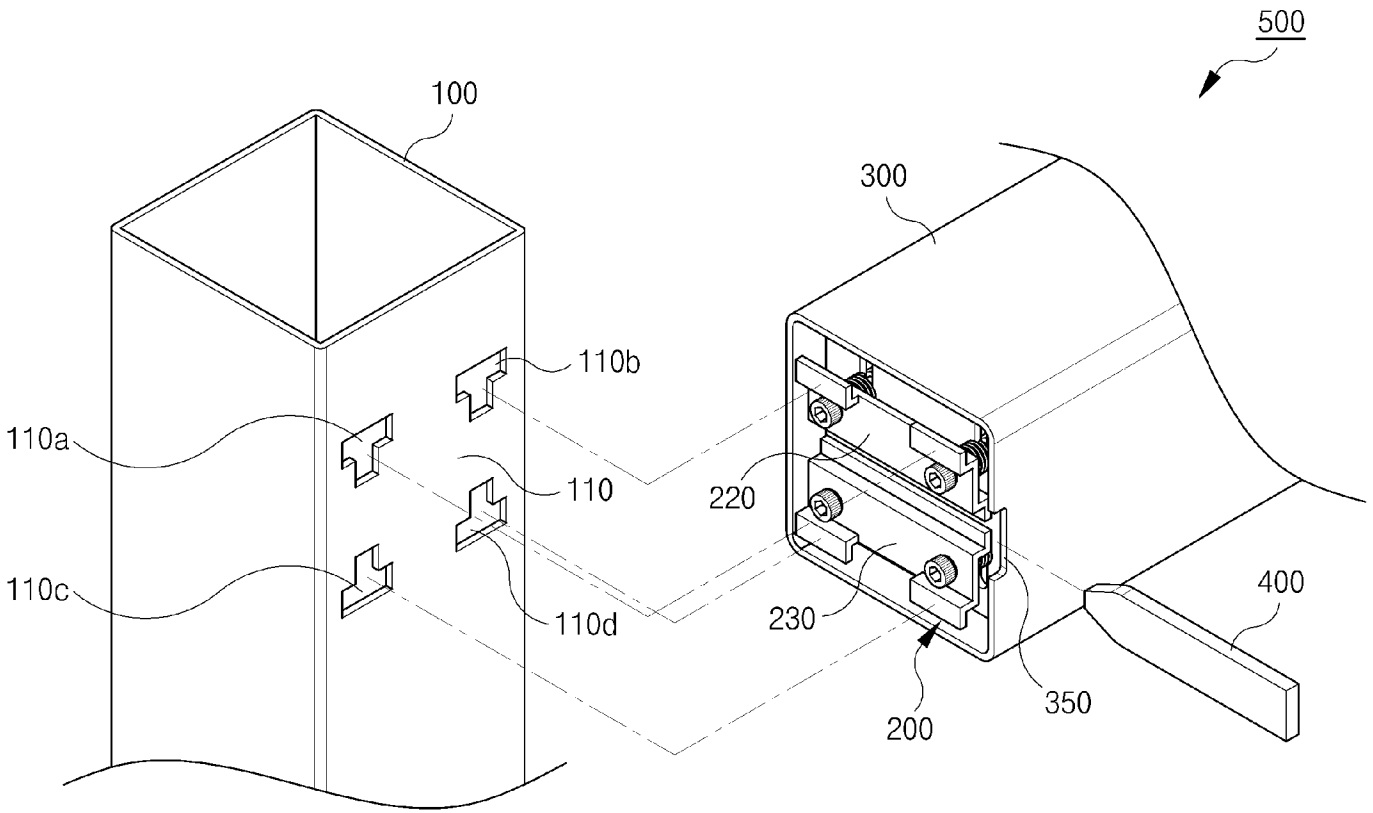

[Fig. 3]
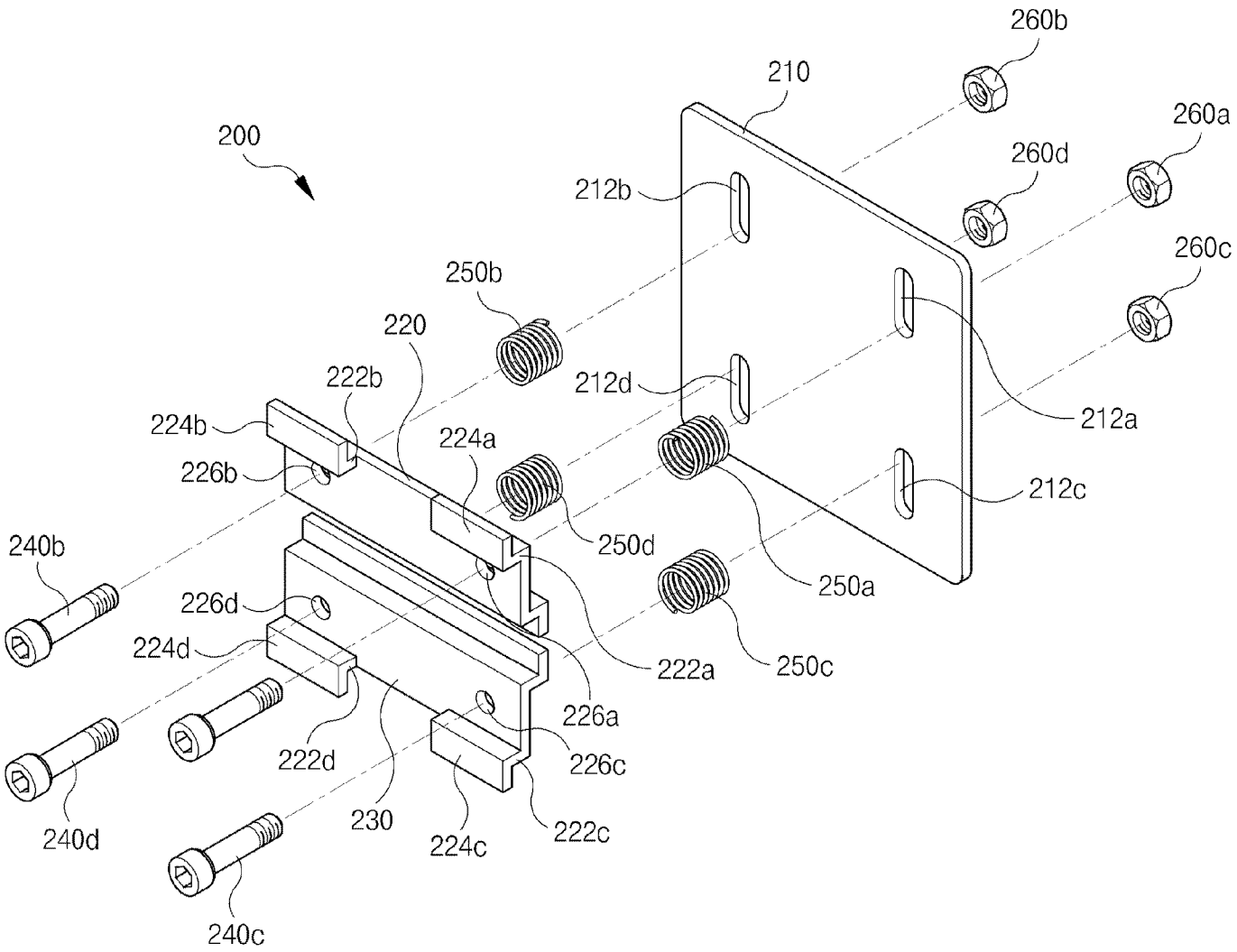

[Fig. 4]
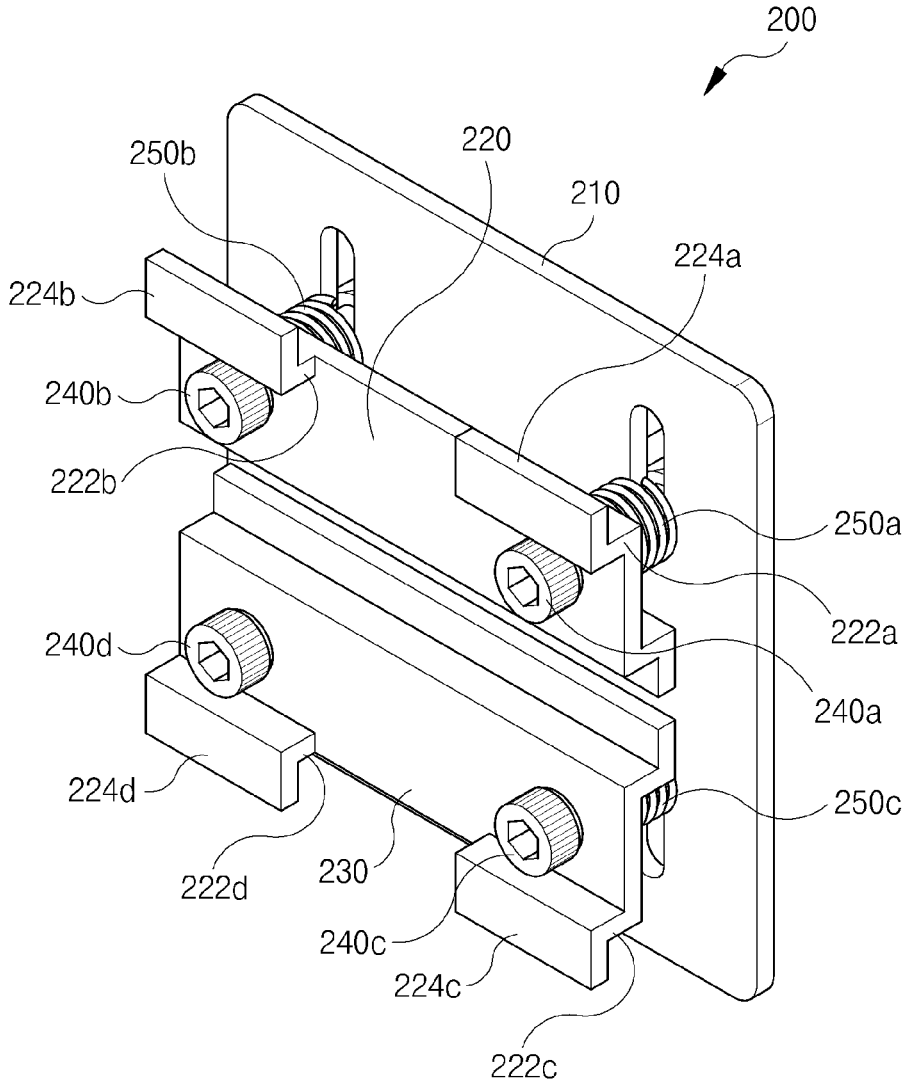

[Fig. 5]
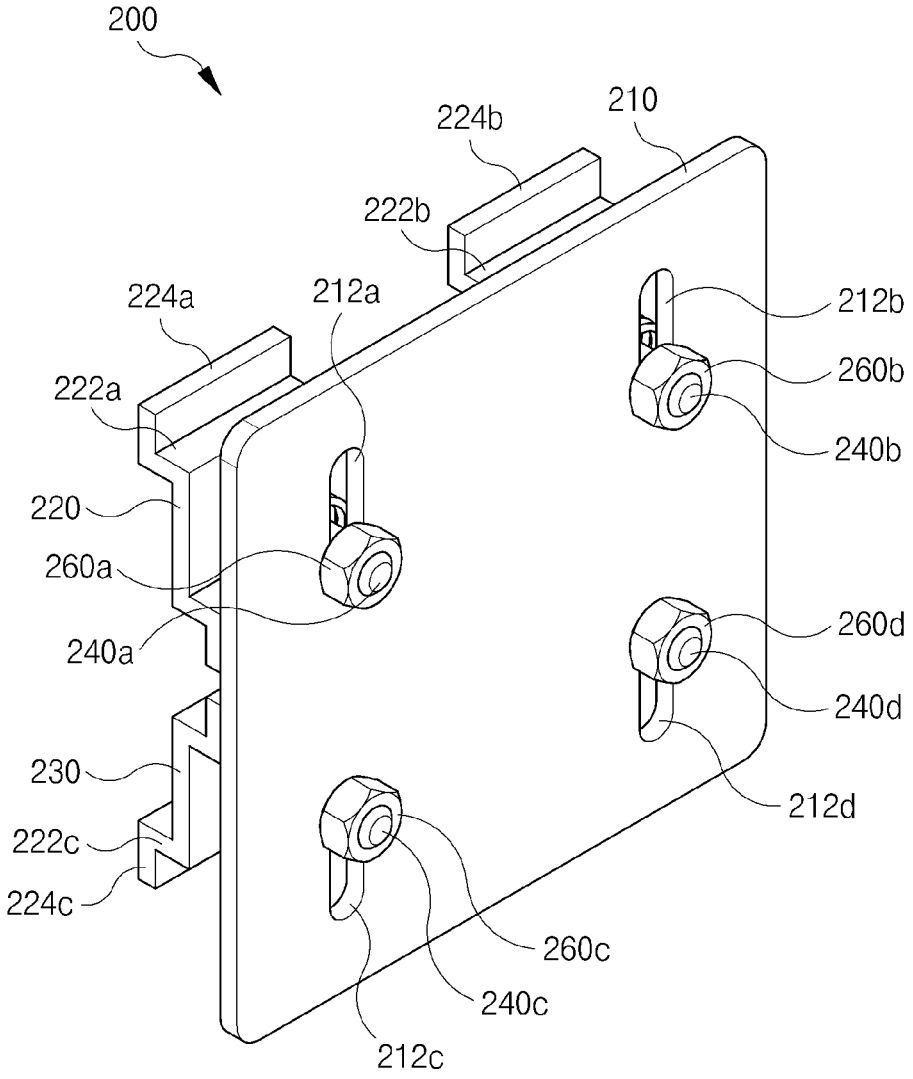

[Fig. 6]
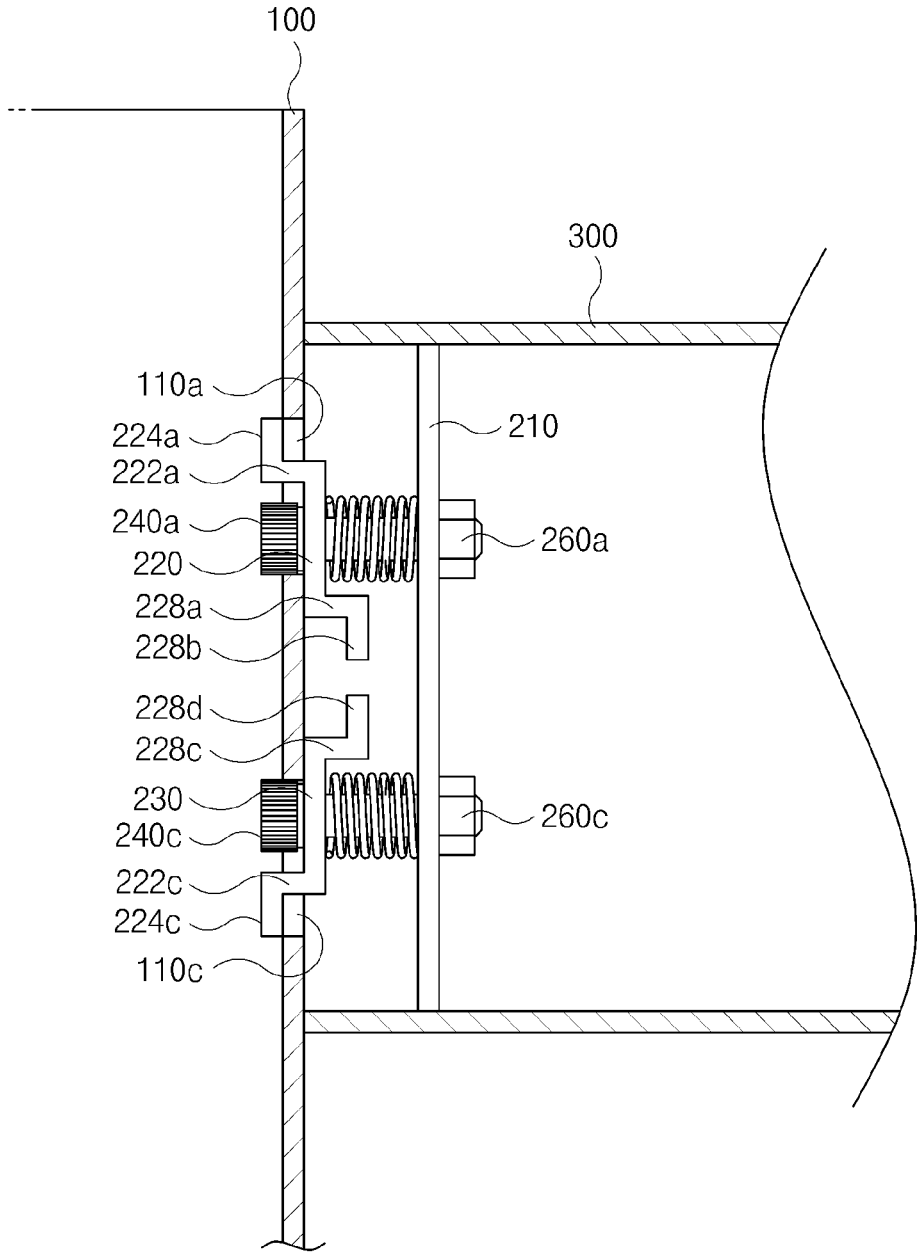

[Fig. 7]
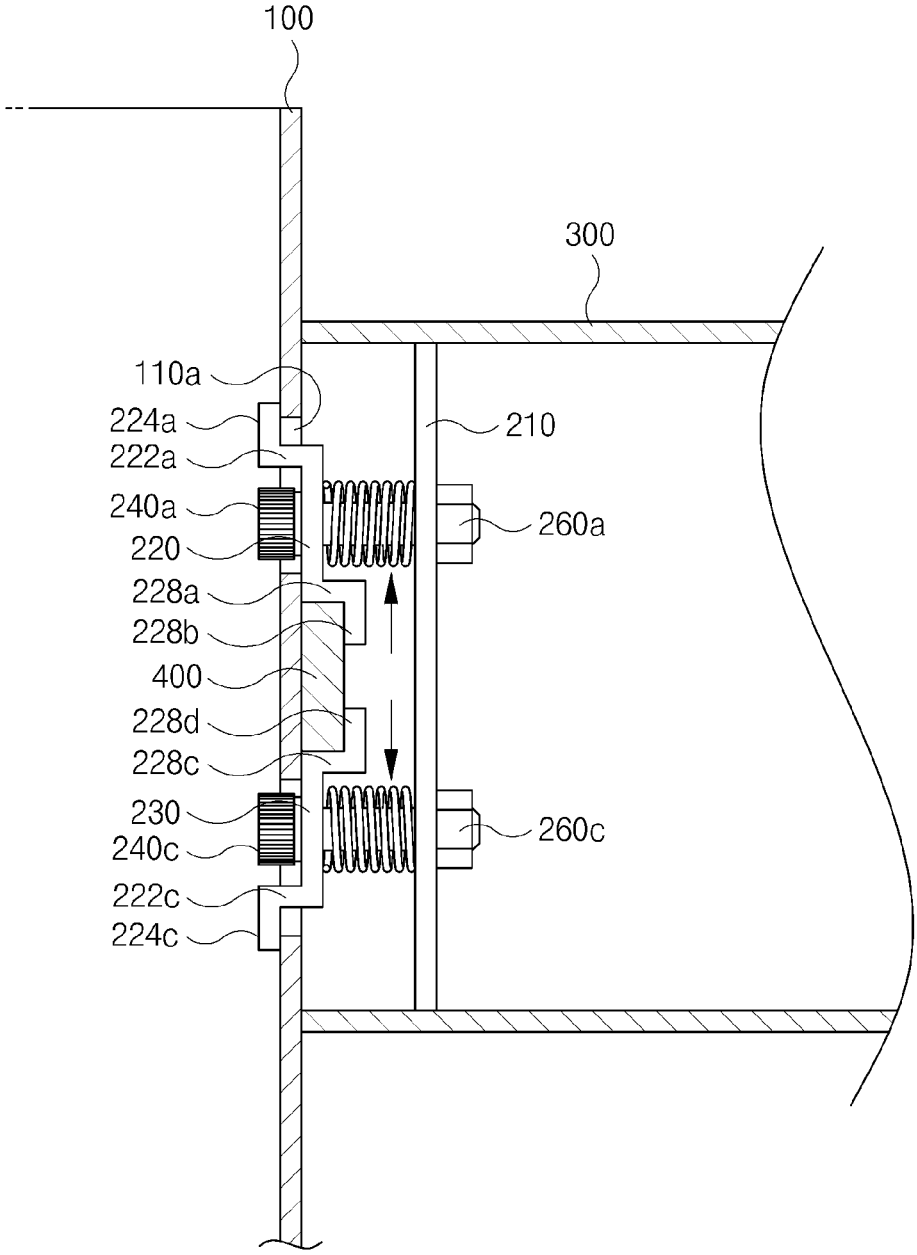

[Fig. 8]
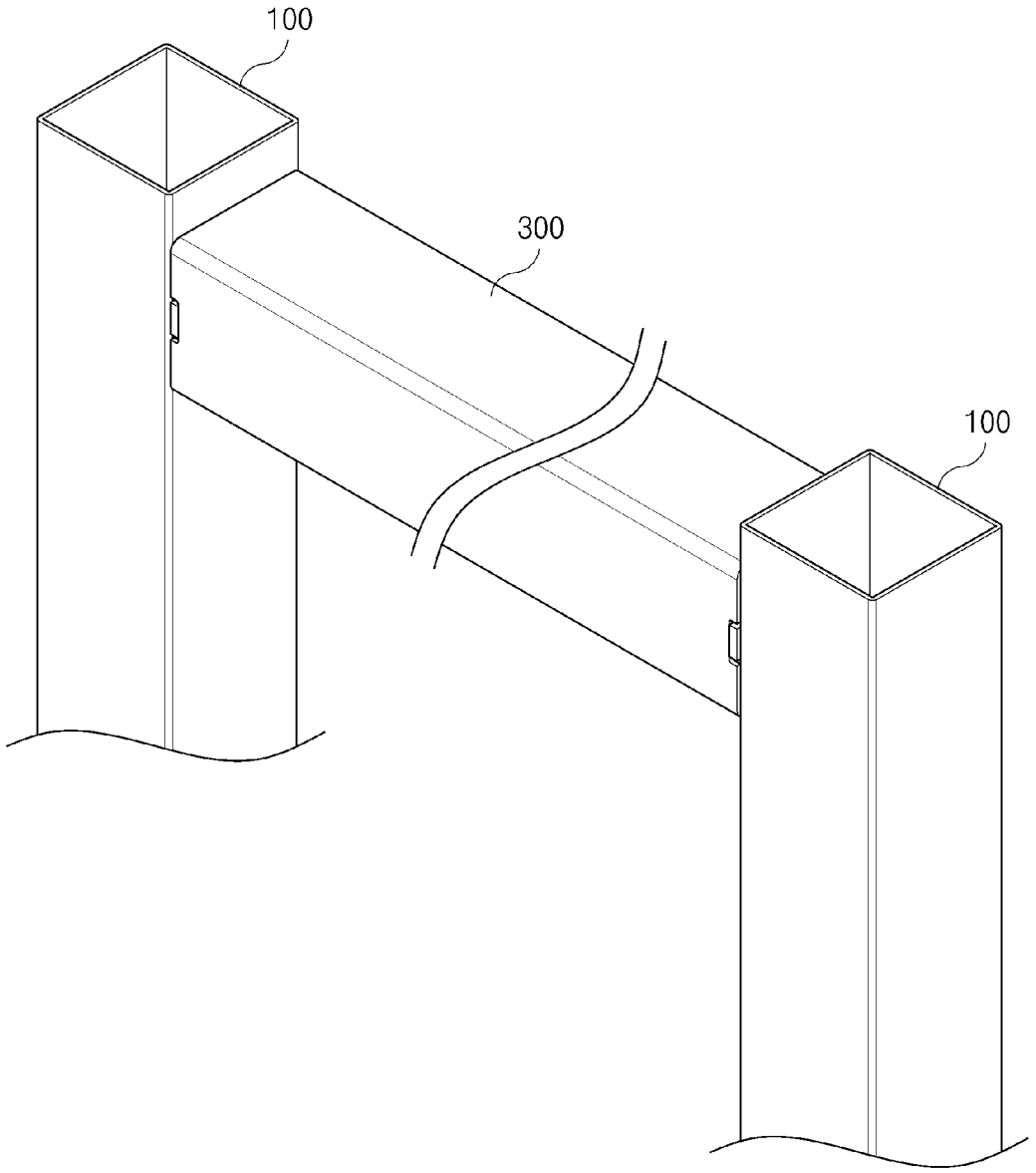

PREFABRICATED POST ASSEMBLY

TECHNICAL FIELD

The present disclosure relates to a prefabricated post assembly and, more particularly, to a prefabricated post assembly that can be simply assembled and firmly coupled.

BACKGROUND ART

In general, when a structure is constructed in the field of construction, structural members such as vertical posts and horizontal posts are made in unit members to be assembled at a site.

For example, in order to couple a vertical post and a horizontal post of a steel-frame structure, a method of partially cutting and joining a horizontal post to a vertical post through welding and then joining the portion of the horizontal post joined to the vertical post and the other portion of the horizontal post using high strength bolts in the process of manufacturing steel frames or at a site is applied.

In this case, welding at a site is maximally avoid and welding at a factory under strict management is recommended for important portions of structural members (a vertical post, a horizontal post, etc.), and various designs are promoted for joints to attenuate stress concentration.

However, such a joining method of the related art has a problem that the joints between vertical posts and horizontal posts break due to poor welding, stress concentration at welded portions, or the like. Further, when a horizontal post is joined to a vertical post through welding, construction ability of highly-skilled engineers is required for welding and a long work time is needed, so there are many problems with construction.

DISCLOSURE

Technical Problem

Accordingly, an objective of the present disclosure is to provide a prefabricated post assembly that can overcome the problems of the related art described above.

Another objective of the present disclosure is to provide a prefabricated post assembly that can be simply and quickly assembled and firmly coupled.

Technical Solution

In order to achieve some of the objectives, a prefabricated post assembly according to an embodiment of the present disclosure includes: a vertical post having at least one assembly surface; and a horizontal post having an assembly module mounted at an end thereof to be coupled to the assembly surface, in which at least one upper insertion hole is formed at an upper portion of the assembly surface and at least one lower insertion hole is formed at a lower portion of the assembly surface, in which the assembly module includes: a base plate welded with an edge thereof in contact with an inner wall of the end of the horizontal post and having a plurality of guide holes formed to correspond to the upper insertion hole and the lower insertion hole, respectively; an upper coupling plate horizontally elongated to cover at least one upper guide hole of the plurality of guide holes and having an upper coupling hole corresponding to the upper guide hole; and a lower coupling plate horizontally elongated to cover at least one lower guide hole of the plurality of guide holes and having a lower coupling hole corresponding to the lower guide hole, in which the upper coupling plate and the base plate are coupled by at least one upper coupling bolt disposed through the upper coupling hole and the upper guide hole, and the lower coupling plate and the base plate are coupled by at least one lower coupling bolt disposed through the lower coupling hole and the lower guide hole, in which at least one upper bending portion bending and extending horizontally toward the assembly surface and at least one upper inserting portion bending upward from an end of the upper bending portion are disposed at an upper end of the upper coupling plate, in which at least one lower bending portion bending and extending horizontally toward the assembly surface and at least one lower inserting portion bending downward from an end of the lower bending portion are disposed at a lower end of the lower coupling plate, and in which the vertical post and the horizontal post are assembled by moving up the at least one upper inserting portion and moving down the at least one lower inserting portion with at least one upper inserting portion inserted in the at least one upper insertion hole and with the at least one lower inserting portion inserted in the at least one lower insertion hole.

At least one upper shock-absorbing spring fastened by the upper coupling bolt disposed through the upper coupling hole, the upper guide hole, and the upper shock-absorbing spring may be disposed between the upper coupling plate and the base plate, and at least one lower shock-absorbing spring fastened by the lower coupling bolt disposed through the lower coupling hole, the lower guide hole, and the lower shock-absorbing spring may be disposed between the lower coupling plate and the base plate.

The upper guide hole and the lower guide hole each may be formed such that an up-down width is larger than a left-right width so that the upper coupling bolt or the lower coupling bolt can be moved up and down.

The upper coupling plate may have a first wedge-bending portion bending and extending horizontally toward the base plate from a lower end thereof, and a second wedge-bending portion bending downward from an end of the first wedge-bending portion; the lower coupling plate may have a third wedge-bending portion bending and extending horizontally toward the base plate from an upper end thereof, and a fourth wedge-bending portion bending upward from an end of the third wedge-bending portion; and the upper inserting portion and the lower inserting portion may be locked in the upper insertion hole and the lower insertion hole by moving up the upper coupling plate and moving down the lower coupling plate by inserting a wedge between the first wedge-bending portion and the third wedge-bending portion with the upper inserting portion and the lower inserting portion inserted in the upper insertion hole and the lower insertion hole, respectively.

The upper insertion hole may have a first insertion hole and a second insertion hole that are each formed in an T-shape such that an upper portion is wide and a lower portion is narrow, and the lower insertion hole may have a third insertion hole and a fourth insertion hole that are each formed in an T-shape such that an upper portion is narrow and a lower portion is wide; and the base plate may have upper guide holes that are a first guide hole and a second guide hole and lower guide holes that are a third guide hole and a fourth guide hole to correspond to the first insertion hole to the fourth insertion hole, respectively.

In order to achieve some of the objectives, a prefabricated post assembly according to an embodiment of the present disclosure includes: a vertical post having a hollow pipe shape having a rectangular cross-section, and having an assembly portion on at least any one side of four sides; and a horizontal post having a hollow pipe shape having a rectangular cross-section, and having an assembly module mounted at an end thereof to be coupled to the assembly portion, in which a first insertion hole and a second insertion hole are formed each in a T-shape at an upper portion of the assembly portion such that an upper portion is wide and a lower portion is narrow, and a third insertion hole and a fourth insertion hole are formed each in a T-shape at a lower portion of the assembly portion such that an upper portion is narrow and a lower portion is wide, in which the assembly module includes: a base plate welded with an edge thereof in contact with an inner wall of the end of the horizontal post and having a first guide hole, a second guide hole, a third guide hole, and a fourth guide hole corresponding to the first insertion hole to the fourth insertion hole, respectively; an upper coupling plate horizontally elongated to cover the first guide hole and the second guide hole, and having a first coupling hole and a second coupling hole corresponding to the first guide hole and the second guide hole; and a lower coupling plate horizontally elongated to cover the third guide hole and the fourth guide hole, and having a third coupling hole and a fourth coupling hole corresponding to the third guide hole and the fourth guide hole, in which the upper coupling plate and the base plate are coupled by a first coupling bolt disposed through the first coupling hole and the first guide hole and a second coupling bolt disposed through the second coupling hole and the second guide hole, and the lower coupling plate and the base plate are coupled by a third coupling bolt disposed through the third coupling hole and the third guide hole and a fourth coupling bolt disposed through the fourth coupling hole and the fourth guide hole, in which a first bending portion bending and extending horizontally toward the assembling portion and a first inserting portion bending and extending upward from an end of the first bending portion are disposed at an end over the first coupling hole of the upper coupling plate, in which a second bending portion bending and extending horizontally toward the assembling portion and a second inserting portion bending and extending upward from an end of the second bending portion are disposed at an end over the second coupling hole of the upper coupling plate, in which a third bending portion bending and extending horizontally toward the assembling portion and a third inserting portion bending and extending downward from an end of the third bending portion are disposed at an end under the third coupling hole of the lower coupling plate, in which a fourth bending portion bending and extending horizontally toward the assembling portion and a fourth inserting portion bending and extending downward from an end of the fourth bending portion are disposed at an end under the fourth coupling hole of the lower coupling plate, and in which the vertical post and the horizontal post are assembled by moving up the upper coupling plate and moving down the lower coupling plate with the first to fourth inserting portions inserted in the first to fourth insertion holes.

Advantageous Effects

According to the present disclosure, there is an advantage that it is possible to simply, quickly, and firmly assemble a horizontal post and a vertical post by mounting an assembly module on an end of the horizontal post.

DESCRIPTION OF DRAWINGS

FIG. 1 is an exploded perspective view of a prefabricated post assembly according to an embodiment of the present disclosure;

FIG. 2 is a perspective view showing a state in which an assembly module has been coupled to a horizontal post;

FIG. 3 is an exploded perspective view of the assembly module;

FIG. 4 is a front perspective view of the assembly module;

FIG. 5 is a rear perspective view of the assembly module;

FIGS. 6 and 7 are cross-sectional views showing states before and after a wedge is coupled; and FIG. 8 shows an example of the prefabricated post assembly assembled in accordance with the present disclosure.

MODE FOR INVENTION

Hereafter, exemplary embodiments of the present disclosure will be described in detail with reference to the accompanying drawings without an intention other than intentions to help those skilled in the art completely understand the present disclosure.

FIG. 1 is an exploded perspective view of a prefabricated post assembly according to an embodiment of the present disclosure, FIG. 2 is a perspective view showing a state in which an assembly module has been coupled to a horizontal post, FIG. 3 is an exploded perspective view of the assembly module, FIG. 4 is a front perspective view of the assembly module, FIG. 5 is a rear perspective view of the assembly module, and FIGS. 6 and 7 are cross-sectional views showing states before and after a wedge is coupled. FIG. 8 shows an example of the prefabricated post assembly assembled in accordance with the present disclosure.

As shown in FIGS. 1, 2, and 8, a post assembly 500 according to an embodiment of the present disclosure a vertical post 100 and a horizontal post 300 are assembled using an assembly surface 110 and an assembly module 200.

The vertical post 100 has a hollow pipe shape and has at least one assembly surface 110. The assembly surface 100 may include a flat surface of a curved surface. The vertical post 100 may include a post having a polygonal cross-section or a cylinder. Anything can be used as long as it has an assembly surface such as a C-channel or an H-beam other than a pipe shape.

In order to convenience of understanding, it is exemplified that the vertical post 100 has a hollow pipe shape having a rectangular cross-section and has the assembly surface 110 on at least any one of four sides.

Several assemblies 110 may be formed on the vertical post 100, the assembly surface 110 may be formed on each of four sides and may be formed only on some sides. Further, when several horizontal posts 300 are coupled to one side, the assembly surface 110 may be formed by the number of the horizontal posts 300 to be coupled.

At least one upper insertion hole 110*a*, 110*b* is formed at the upper portion of the assembly surface 110 and at least one low insertion hole 110*c*, 110*d* is formed at the lower portion of the assembly surface 110. The upper insertion hole 110*a*, 110*b* may include one or more insertion holes, and the case in which two upper insertion holes of a first insertion hole 110*a* and a second insertion hole 110*b* are formed is shown in the figures. Further, the lower insertion hole 110*c*, 110*d* may include one or more lower insertion holes, and the case in which two lower insertion holes of a third insertion hole 110*c* and a fourth insertion hole 110*d* are formed is shown in the figures.

That is, a first insertion hole 110*a* and a second insertion hole 110*b* are formed to be spaced left and right apart from each other as the upper insertion holes 110*a* and 110*b*, and a third insertion hole 110*c* and a fourth insertion hole 110*d* are formed to be spaced left and right apart from each other as the lower insertion holes 110*c*, and 110*d*.

The upper insertion holes 110*a* and 110*b* and the lower insertion holes 110*c*, and 110*d* may have any structure as long as inserting portions 224*a*, 224*b*, 224*c*, and 224*d* and the heads of coupling bolts 240*a*, 240*b*, 240*c*, and 240*d* to be described below can be inserted therein. Various insertion hole structures such as a polygon including a rectangle and a circle may be possible.

It is exemplified in the figures that the first insertion hole 110*a* and the second insertion hole 110*b* that are upper insertion holes each have a T-shaped structure with a wide upper portion and a narrow lower portion and the third insertion hole 110*c* and the fourth insertion hole 110*d* that are lower insertion holes each have a T-shaped structure with a narrow upper portion and a wide lower portion. The first to fourth insertion holes 110*a*, 110*b*, 110*c*, and 110*d* are formed to be symmetric up, down, left, and right. That is, as for the first insertion hole 110*a*, the first insertion hole 110*a* is left-right symmetric to the second insertion hole 110 and is up-down symmetric to the third insertion hole 110*c*. Further, as for the fourth insertion hole 110*d*, the fourth insertion hole 110*d* is left-right symmetric to the third insertion hole 110*c* and is up-down symmetric to the second insertion hole 110*b*.

The wide hole portions of the holes of the T-shaped structures of the first to fourth insertion holes 110*a*, 110*b*, 110*c*, and 110*d* are portions in which the first to fourth inserting portions 224*a*, 224*b*, 224*c*, and 224*d* are inserted, and the narrow hole portions are portions in which the heads of the first to fourth coupling bolts 240*a*, 240*b*, 240*c*, and 240*d* are inserted.

The horizontal post 300 is equipped with an assembly module 200 for coupling to the assembly surface 110 at a horizontal end. The horizontal post 300 may include a hollow pipe shape, a post having a polygonal cross-section including a rectangle, or a cylinder. Further, the horizontal post 300 may be a C-channel, an H-beam, or the like other than a pipe shape, and may have any structure as long as the assembly module 200 can be mounted at an end thereof.

For convenience of understanding, it is exemplified hereafter that the horizontal post 300 has a hollow pipe shape having a rectangular cross-section.

The assembly module 200 may be mounted at each of both ends of the horizontal post 300 and coupled to connect two vertical posts 100. A wedge insertion opening 350 for inserting a wedge 400 to be described below is formed at an end of the horizontal post 300.

The assembly module 200, as shown in FIGS. 3 to 5, has a base plate 210, an upper coupling plate 220, and a lower coupling plate 230.

The base plate 210 has a shape corresponding to the cross-section of the horizontal post 300 and is welded with the edge in contact with the inner wall of the horizontal post 300. The base plate 210 is inserted inward a predetermined distance from an end of the horizontal post 300 and is welded with the edge in contact with the inner wall. Welding of the base plate 210 is performed to fix the assembly module 200 to the horizontal post 300.

When the horizontal post 300 does not have a pipe shape, it is impossible to weld the base plate 210 to the inner wall of an end of the horizontal post 300. Accordingly, the base plate 210 is welded in contact with an end of the horizontal post 300 and a cover that covers the base plate 210, the upper coupling plate 220, and the lower coupling plate 230 may be further disposed on the edge of the base plate 210 to hide the plates from the outside.

At the base plate 210, a first guide hole 212*a* and a second guide hole 212*b*, which are at least one upper guide hole, are formed to correspond to the first insertion hole 110*a* and the second insertion hole 110*b* that are upper insertion holes, and a third guide hole 212*c* and a fourth guide hole 212*d*, which are at least one lower guide hole, are formed to correspond to the third insertion hole 110*c* and the fourth insertion hole 110*d* that are lower insertion holes, respectively. The up-down widths of the first guide hole 212*a*, the second guide hole 212*b*, the third guide hole 212*c*, and the fourth guide hole 212*d* are larger than the left-right widths thereof, so the coupling bolts 240*a*, 240*b*, 240*c*, and 240*d* disposed through the first guide hole 212*a*, the second guide hole 212*b*, the third guide hole 212*c*, and the fourth guide hole 212*d*, respectively, can be moved up and down along the guide holes.

The upper coupling plate 220 is horizontally elongated to cover the first guide hole 212*a* and the second guide hole 212*b*, which are the at least one upper guide hole, and a first coupling hole 226*a* and a second coupling hole 226*b* that are upper coupling holes corresponding to the first guide hole 212*a* and the second guide hole 212*b* are formed at the upper coupling plate 220.

The first coupling hole 226*a* and the second coupling hole 226*b* may have a size that is enough for the upper coupling holes 240*a* and 240*b* to be inserted therethrough, unlike the first guide hole 212*a* and the second guide hole 212*b*, and the upper coupling bolts 240*a* and 240*b* and the upper coupling plate 220 may be integrally firmly coupled when the first and second coupling bolts 240*a* and 240*b* that are upper coupling bolts are fastened.

In detail, the upper coupling plate 220 and the base plate 210 are coupled by the first coupling bolt 240*a* disposed through the first coupling hole 226*a* and the first guide hole 212*a* and the second coupling bolt 240*b* disposed through the second coupling hole 226*b* and the second guide hole 212*b*. The first coupling bolt 240*a* is disposed sequentially through the first coupling hole 226*a* and the first guide hole 212*a* with the head on the front surface of the upper coupling plate 220, and is coupled to a first coupling nut 260*a* on the rear surface of the base plate 210. Further, the second coupling bolt 240*b* is disposed sequentially through the second coupling hole 226*b* and the second guide hole 212*b* with the head on the front surface of the upper coupling plate 220, and is coupled to a second coupling nut 260*b* on the rear surface of the base plate 210.

The upper coupling plate 220 integrated with the first coupling bolt 240*a* and the second coupling bolt 240*b* has a configuration that is guided to be movable up and down because the first guide hole 212*a* and the second guide hole 212*b* have a hole structure that can be moved up and down. That is, the upper coupling plate 220 has a structure that can be moved up and down by the up-down width of the first and second guide holes 212*a* and 212*b* when an up-down external force is applied.

In order that the upper coupling plate 220 is spaced a predetermined distance apart from the base plate 210 without contact when the upper coupling plate 220 is combined with the base plate 210 by the first coupling bolt 240*a* and the second coupling bolt 240*b*, a first shock-absorbing spring 250*a* and a second shock-absorbing spring 250*b* that are upper shock-absorbing springs are disposed between the upper coupling plate 220 and the base plate 210. The first shock-absorbing spring 250*a* may have various shapes such as a coil spring, ring spring, or plate spring shape and the first coupling bolt 240*a* is disposed therethrough. The second shock-absorbing spring 250*b* may have various shapes such as a coil spring, a ring spring, or a plate spring shape and the second coupling bolt 240*b* is disposed therethrough. The first shock-absorbing spring 250*a* and the second shock-absorbing spring 250*b* serve to absorb shock and support the upper coupling plate 220 between the upper coupling plate 220 and the base plate 210.

At least one upper bending portion 222*a*, 222*b* bending and extending horizontally toward the assembly surface 110 and at least one upper inserting portion 224*a*, 224*b* bending and extending upward from the end of the upper bending portion 222*a*, 222*b* may be provided at the upper end of the upper coupling plate 220. The at least one upper inserting portion 224*a*, 224*b* is inserted in the at least one upper insertion hole 110*a*, 110*b*.

Referring to the figures as an example, a first bending portion 222*a* that is one upper bending portion bending and extending horizontally toward the assembly surface 110 and a first inserting portion 224*a* that is one upper inserting portion bending and extending upward from an end of the first bending portion 222*a* are disposed at the end over the first coupling hole 226*a* of the upper coupling plate 220. The first bending portion 222*a*, as shown in the cross-sectional views of FIGS. 6 and 7, may extend a distance corresponding to the thickness between the outer side and the inner side of the vertical post 100. That is, the first bending portion 222*a* may have an extension length by the depth of the first insertion hole 110*a*. This is for bringing the front surface of the upper coupling plate 220 in close contact with the outer surface of the vertical post 100 when the vertical post 100 and the horizontal post 300 are assembled. The first inserting portion 224*a* extends in a size that can be inserted in the wide hole portion of the first insertion hole 110*a*. For reference, when the assembly module 200 is coupled to the assembly surface 110, the first inserting portion 224*a* is inserted in the wide hole portion of the first insertion hole 110*a* and the head of the first coupling bolt 240*a* is inserted in the narrow hole portion of the first insertion hole 110*a*. When the upper coupling plate 220 is moved up along the first and second guide holes 212*a* and 212*b* with the first inserting portion 224*a* inserted in the first insertion hole 110*a*, the first inserting portion 224*a* is also moved up in the vertical post 100 and stopped by the upper surface of the first insertion hole 110*a*, so the first inserting portion 224*a* can keep firmly coupled without separating from the first insertion hole 110*a*.

A second bending portion 222*b* that is another upper bending portion bending and extending horizontally toward the assembly surface 110 and a second inserting portion 224*b* that is another upper inserting portion bending and extending upward from an end of the second bending portion 222*b* are disposed at the end over the second coupling hole 226*b*. The second bending portion 222*b*, as shown in the cross-sectional views of FIGS. 6 and 7, may extend a distance corresponding to the thickness between the outer side and the inner side of the vertical post 100. That is, the second bending portion 222*b* may have an extension length by the depth of the second insertion hole 110*b*. This is for bringing the front surface of the upper coupling plate 220 in close contact with the outer surface of the vertical post 100 when the vertical post 100 and the horizontal post 300 are assembled. The second inserting portion 224*b* extends in a size that can be inserted in the wide hole portion of the second insertion hole 110*b*. For reference, when the assembly module 200 is coupled to the assembly surface 110, the second inserting portion 224*b* is inserted in the wide hole portion of the second insertion hole 110*b* and the head of the second coupling bolt 240*b* is inserted in the narrow hole portion of the second insertion hole 110*b*. When the upper coupling plate 220 is moved up along the first and second guide holes 212*a* and 212*b* with the second inserting portion 224*b* inserted in the second insertion hole 110*b*, the second inserting portion 224*b* is also moved up in the vertical post 100 and stopped by the upper surface of the second insertion hole 110*b*, so the second inserting portion 224*b* can keep firmly coupled without separating from the second insertion hole 110*b*.

The lower coupling plate 220 is horizontally elongated to cover the third guide hole 212*c* and the fourth guide hole 212*d*, which are the at least one lower guide hole, and a third coupling hole 226*c* and a fourth coupling hole 226*d* that are lower coupling holes corresponding to the third guide hole 212*c* and the fourth guide hole 212*d* are formed at the lower coupling plate 230.

The third coupling hole 226*c* and the fourth coupling hole 226*d* may have a size that is enough for the lower coupling bolts 240*c* and 240*d* to be inserted therethrough, unlike the third coupling hole 226*c* and the fourth coupling hole 226*d*, and the third and fourth coupling bolts 240*c* and 240*d* and the lower coupling plate 230 may be integrally firmly coupled when the third and fourth coupling bolts 240*c* and 240*d* that are lower coupling bolts are fastened.

In detail, the lower coupling plate 230 and the base plate 210 are coupled by the third coupling bolt 240*c* disposed through the third coupling hole 226*c* and the third guide hole 212*c* and the fourth coupling bolt 240*d* disposed through the fourth coupling hole 226*d* and the fourth guide hole 212*d*. The third coupling bolt 240*c* is disposed sequentially through the third coupling hole 226*c* and the third guide hole 212*c* with the head on the front surface of the lower coupling plate 230, and is coupled to a third coupling nut 260*c* on the rear surface of the base plate 210. Further, the fourth coupling bolt 240*d* is disposed sequentially through the fourth coupling hole 226*d* and the fourth guide hole 212*d* with the head on the front surface of the upper coupling plate 230, and is coupled to a fourth coupling nut 260*d* on the rear surface of the base plate 210.

The lower coupling plate 230 integrated with the third coupling bolt 240*c* and the fourth coupling bolt 240*d* has a configuration that is guided to be movable up and down because the third guide hole 212*c* and the fourth guide hole 212*d* have a hole structure that can be moved up and down. That is, the lower coupling plate 230 has a structure that can be moved up and down by the up-down width of the third and fourth guide holes 212*c* and 212*d* when an up-down external force is applied.

In order that the lower coupling plate 230 is spaced a predetermined distance apart from the base plate 210 without contact when the lower coupling plate 230 is combined with the base plate 210 by the third coupling bolt 240*c* and the fourth coupling bolt 240*d*, a third shock-absorbing spring 250*c* and a fourth shock-absorbing spring 250*d* that are lower shock-absorbing springs are disposed between the lower coupling plate 230 and the base plate 210. The third shock-absorbing spring 250*c* may have various shapes such as a coil spring, ring spring, or plate spring shape and the third coupling bolt 240*c* is disposed therethrough. The fourth shock-absorbing spring 250*d* may have various shapes such as a coil spring, a ring spring, or a plate spring shape and the fourth coupling bolt 240*d* is disposed therethrough. The third shock-absorbing spring 250*c* and the fourth shock-absorbing spring 250*d* serve to absorb shock and support the lower coupling plate 230 between the lower coupling plate 230 and the base plate 210.

At least one lower bending portion 222*c*, 222*d* bending and extending horizontally toward the assembly surface 110 and at least one lower inserting portion 224*c*, 224*d* bending and extending downward from the end of the lower bending portion 222*a*, 222*b* may be provided at the lower end of the upper coupling plate 230. The at least one lower inserting portion 224*c*, 224*d* is inserted in the at least one lower insertion hole 110*c*, 110*d*.

Referring to the figures as an example, a third bending portion 222*c* that is one lower bending portion bending and extending horizontally toward the assembly surface 110 and a third inserting portion 224*c* that is one lower inserting portion bending and extending downward from an end of the third bending portion 222*c* are disposed at the end under the third coupling hole 226*c* of the lower coupling plate 230. The third bending portion 222*c*, as shown in the cross-sectional views of FIGS. 6 and 7, may extend a distance corresponding to the thickness between the outer side and the inner side of the vertical post 100. That is, the third bending portion 222*c* may have an extension length by the depth of the third insertion hole 110*a*. This is for bringing the front surface of the lower coupling plate 230 in close contact with the outer surface of the vertical post 100 when the vertical post 100 and the horizontal post 300 are assembled. The third inserting portion 224*c* extends in a size that can be inserted in the wide hole portion of the third insertion hole 110*c*. For reference, when the assembly module 200 is coupled to the assembly surface 110, the third inserting portion 224*c* is inserted in the wide hole portion of the third insertion hole 110*c* and the head of the third coupling bolt 240*c* is inserted in the narrow hole portion of the third insertion hole 110*c*. When the lower coupling plate 230 is moved down along the third and fourth guide holes 212*c* and 212*d* with the third inserting portion 224*c* inserted in the third insertion hole 110*c*, the third inserting portion 224*c* is also moved down in the vertical post 100 and stopped by the lower surface of the third insertion hole 110*b*, so the third inserting portion 224*c* can keep firmly coupled without separating from the third insertion hole 110*c*.

A fourth bending portion 222*d* that is another lower bending portion bending and extending horizontally toward the assembly surface 110 and a fourth inserting portion 224*d* that is another lower inserting portion bending and extending downward from an end of the fourth bending portion 222*d* are disposed at the end under the fourth coupling hole 226*d*. The fourth bending portion 222*d*, as shown in the cross-sectional views of FIGS. 6 and 7, may extend a distance corresponding to the thickness between the outer side and the inner side of the vertical post 100. That is, the fourth bending portion 222*d* may have an extension length by the depth of the fourth insertion hole 110*d*. This is for bringing the front surface of the lower coupling plate 230 in close contact with the outer surface of the vertical post 100 when the vertical post 100 and the horizontal post 300 are assembled. The fourth inserting portion 224*d* extends in a size that can be inserted in the wide hole portion of the fourth insertion hole 110*d*. For reference, when the assembly module 200 is coupled to the assembly surface 110, the fourth inserting portion 224*d* is inserted in the wide hole portion of the fourth insertion hole 110*d* and the head of the fourth coupling bolt 240*d* is inserted in the narrow hole portion of the fourth insertion hole 110*d*. When the lower coupling plate 230 is moved down along the third and fourth guide holes 212*c* and 212*d* with the fourth inserting portion 224*d* inserted in the fourth insertion hole 110*d*, the fourth inserting portion 224*d* is also moved down in the vertical post 100 and stopped by the lower surface of the fourth insertion hole 110*d*, so the fourth inserting portion 224*d* can keep firmly coupled without separating from the fourth insertion hole 110*d*.

Meanwhile, when the upper coupling plate 220 and the lower coupling plate 230 of the assembling module 200 of the present disclosure are assembled, the wedge 400 is inserted between the upper coupling plate 220 and the lower coupling plate 230 such that the upper coupling plate 220 and the first and second inserting portions 224*a* and 224*b* that are upper inserting portions extending from the upper coupling plate 220 are moved up and such that the lower coupling plate 230 and the third and fourth inserting portions 224*c* and 224*d* that are lower inserting portions extending from the lower coupling plate 230 are moved up, whereby a firmly assembled state is maintained.

To this end, the upper coupling plate 220 may have a first wedge-bending portion 228*a* and a second wedge-bending portion 228*b* and the lower coupling plate 230 may have a third wedge-bending portion 228*c* and a fourth wedge-bending portion 228*d*.

The first wedge-bending portion 228*a* bends and extends horizontally toward the base plate 210 from the lower end of the upper coupling plate 220 and the second wedge-bending portion 228*b* bends downward from an end of the first wedge-bending portion 228*a*. The first wedge-bending portion 228*a* may have a length the same as or larger than the thickness of the wedge 400 to be inserted. The second wedge-bending portion 228*b* has only to have a length not to come in contact with the fourth wedge-bending portion 228*d* even though it is moved closest to the fourth wedge-bending portion 228*d*. That is, a length should be secured so that the second wedge-bending portion 228*b* and the fourth wedge-bending portion 228*d* do not come in contact with each other when the upper coupling plate 220 is moved down and the lower coupling plate 230 is moved up.

The third wedge-bending portion 228*c* bends and extends horizontally toward the base plate 210 from the upper end of the lower coupling plate 220 and the fourth wedge-bending portion 228*d* bends upward from an end of the third wedge-bending portion 228*c*. The third wedge-bending portion 228*c* may have a length the same as or larger than the thickness of the wedge 400 that is inserted. The fourth wedge-bending portion 228*d* has only to have a length not to come in contact with the second wedge-bending portion 228*b* even though it is moved closest to the second wedge-bending portion 228*b*. That is, a length should be secured so that the second wedge-bending portion 228*b* and the fourth wedge-bending portion 228*d* do not come in contact with each other when the upper coupling plate 220 is moved down and the lower coupling plate 230 is moved up.

The assembly module 200 having the structure described above, as shown in FIGS. 2, 6, and 7, is inserted in the horizontal post 300 such that only the first to fourth bending portions 222*a*, 222*b*, 222*c*, and 222*d* and the first to fourth inserting portions 224*a*, 224*b*, 224*c*, and 224*d* protrude. Accordingly, when the assembly module 200 mounted on the horizontal post 300 is coupled to the assembly surface 110 of the vertical post 100, the end of the horizontal post 300 can be in close contact with the assembly surface 110 of the vertical post 100. This is possible because the first to fourth bending portions 222*a*, 222*b*, 222*c*, and 222*d* have a length corresponding to the thickness between the inside of the vertical post 100 and the outside and the first to fourth inserting portions 224*a*, 224*b*, 224*c*, and 224*d* are inserted in the first to fourth insertion holes 110*a*, 110*b*, 110*c*, and 110*d* of the assembly surface 110. The assembly module 200 can be mounted by welding the edge of the base plate 210 to the inner surface of the horizontal post 300.

In this state, in order to assemble the vertical post 100 and the horizontal post 300, as shown in FIG. 2, the first to fourth inserting portions 224*a*, 224*b*, 224*c*, and 224*d* of the assembly module 200 are inserted first in the first to fourth insertion holes 110*a*, 110*b*, 110*c*, and 110*d* of the vertical post 100 such that the end of the horizontal post 300 comes in close contact with the assembly surface 110 of the vertical post 100, as shown in FIG. 6.

The upper coupling plate 220 and the lower coupling plate 230 have a structure that can be moved forward and backward by the shock-absorbing springs 250*a*, 250*b*, 250*c*, and 250*d* disposed between the base plate 210 and the upper and lower coupling plates.

Accordingly, when the first to fourth inserting portions 224*a*, 224*b*, 224*c*, and 224*d* of the assembly module 200 do not reach the first to fourth insertion holes 110*a*, 110*b*, 110*c*, 110*d* of the vertical post 100 and are not inserted in the insertion holes with the end of the horizontal post 300 in close contact with the assembly surface 110 of the vertical post 100, the shock-absorbing springs 250*a*, 250*b*, 250*c*, and 250*d* are contracted, whereby the upper coupling plate 220 and the lower coupling plate 230 are moved backward. When the first to fourth inserting portions 224*a*, 224*b*, 224*c*, and 224*d* of the assembly module 200 reach the first to fourth insertion holes 110*a*, 110*b*, 110*c*, 110*d* of the vertical post 100, the shock-absorbing springs 250*a*, 250*b*, 250*c*, and 250*d* are stretched and the upper coupling plate 220 and the lower coupling plate 230 are moved forward, whereby the first to fourth inserting portions 224*a*, 224*b*, 224*c*, and 224*d* of the assembly module 200 are inserted into the first to fourth insertion holes 110*a*, 110*b*, 110*c*, 110*d* of the vertical post 100.

In this state, as shown in FIG. 7, the wedge 400 is inserted between the first wedge-bending portion 228*a* and the third wedge-bending portion 228*c*, whereby the upper coupling plate 220 is moved up and the lower coupling plate 230 is moved down. As the upper coupling plate 220 is moved up, the first inserting portion 224*a* and the second inserting portion 224*b* integrated with the upper coupling plate 200 are moved up in the vertical post 100 and are stopped not to be pulled out by the upper surfaces of the first insertion hole 110*a* and the second insertion hole 110*b*. Further, as the lower coupling plate 230 is moved down, the third inserting portion 224*c* and the fourth inserting portion 224*d* integrated with the lower coupling plate 230 are moved down in the vertical post 100 and are stopped not to be pulled out by the lower surfaces of the third insertion hole 110*c* and the fourth insertion hole 110*d*.

Accordingly, as shown in FIG. 8, the horizontal post 100 and the vertical post 300 can be firmly coupled to each other.

As described above, according to the present disclosure, there is an advantage that the assembly module 200 is mounted on an end of a horizontal post, whereby it is possible to simply, quickly, and firmly assemble the horizontal post and a vertical post.

The description of embodiments is provided only an example referring to the figures for more complete understanding of the present disclosure and should not be construed as limiting the present disclosure. Further, it would be apparent to those skilled in the art that he present disclosure may be changed and modified in various ways without departing from the fundamental principle of the present disclosure.

The invention claimed is:

1. A prefabricated post assembly, comprising:

a vertical post having at least one assembly surface; and a horizontal post having an assembly module mounted at an end thereof to be coupled to the assembly surface, wherein at least one upper insertion hole is formed at an upper portion of the assembly surface and at least one lower insertion hole is formed at a lower portion of the assembly surface, wherein the assembly module includes:

a base plate welded with an edge thereof in contact with an inner wall of the end of the horizontal post and having a plurality of guide holes formed to correspond to the upper insertion hole and the lower insertion hole, respectively;

an upper coupling plate horizontally elongated to cover at least one upper guide hole of the plurality of guide holes and having an upper coupling hole corresponding to the upper guide hole; and a lower coupling plate horizontally elongated to cover at least one lower guide hole of the plurality of guide holes and having a lower coupling hole corresponding to the lower guide hole, wherein the upper coupling plate and the base plate are coupled by at least one upper coupling bolt disposed through the upper coupling hole and the upper guide hole, and the lower coupling plate and the base plate are coupled by at least one lower coupling bolt disposed through the lower coupling hole and the lower guide hole, wherein at least one upper bending portion bending and extending horizontally toward the assembly surface and at least one upper inserting portion bending upward from an end of the upper bending portion are disposed at an upper end of the upper coupling plate, wherein at least one lower bending portion bending and extending horizontally toward the assembly surface and at least one lower inserting portion bending downward from an end of the lower bending portion are disposed at a lower end of the lower coupling plate, and wherein the vertical post and the horizontal post are assembled by moving up the at least one upper inserting portion and moving down the at least one lower inserting portion with at least one upper inserting portion inserted in the at least one upper insertion hole and with the at least one lower inserting portion inserted in the at least one lower insertion hole.

2. The prefabricated post assembly of claim 1, wherein at least one upper shock-absorbing spring fastened by the upper coupling bolt disposed through the upper coupling hole, the upper guide hole, and the upper shock-absorbing spring is disposed between the upper coupling plate and the base plate, and at least one lower shock-absorbing spring fastened by the lower coupling bolt disposed through the lower coupling hole, the lower guide hole, and the lower shock-absorbing spring is disposed between the lower coupling plate and the base plate.

3. The prefabricated post assembly of claim 2, wherein the upper guide hole and the lower guide hole are each formed such that an up-down width is larger than a left-right width so that the upper coupling bolt or the lower coupling bolt can be moved up and down.

4. The prefabricated post assembly of claim 3, wherein the upper coupling plate has a first wedge-bending portion bending and extending horizontally toward the base plate from a lower end thereof, and a second wedge-bending portion bending downward from an end of the first wedge-bending portion, the lower coupling plate has a third wedge-bending portion bending and extending horizontally toward the base plate from an upper end thereof, and a fourth wedge-bending portion bending upward from an end of the third wedge-bending portion, and the upper inserting portion and the lower inserting portion are locked in the upper insertion hole and the lower insertion hole by moving up the upper coupling plate and moving down the lower coupling plate by inserting a wedge between the first wedge-bending portion and the third wedge-bending portion with the upper inserting portion and the lower inserting portion inserted in the upper insertion hole and the lower insertion hole, respectively.

5. The prefabricated post assembly of claim 1, wherein the upper insertion hole has a first insertion hole and a second insertion hole that are each formed in an T-shape such that an upper portion is wide and a lower portion is narrow, and the lower insertion hole has a third insertion hole and a fourth insertion hole that are each formed in an T-shape such that an upper portion is narrow and a lower portion is wide; and the base plate has upper guide holes that are a first guide hole and a second guide hole and lower guide holes that are a third guide hole and a fourth guide hole to correspond to the first insertion hole to the fourth insertion hole, respectively.

6. A prefabricated post assembly comprising:

a vertical post having a hollow pipe shape having a rectangular cross-section, and having an assembly portion on at least any one side of four sides; and a horizontal post having a hollow pipe shape having a rectangular cross-section, and having an assembly module mounted at an end thereof to be coupled to the assembly portion, wherein a first insertion hole and a second insertion hole are formed each in a T-shape at an upper portion of the assembly portion such that an upper portion is wide and a lower portion is narrow, and a third insertion hole and a fourth insertion hole are formed each in a T-shape at a lower portion of the assembly portion such that an upper portion is narrow and a lower portion is wide, wherein the assembly module includes:

a base plate welded with an edge thereof in contact with an inner wall of the end of the horizontal post and having a first guide hole, a second guide hole, a third guide hole, and a fourth guide hole corresponding to the first insertion hole to the fourth insertion hole, respectively;

an upper coupling plate horizontally elongated to cover the first guide hole and the second guide hole, and having a first coupling hole and a second coupling hole corresponding to the first guide hole and the second guide hole; and a lower coupling plate horizontally elongated to cover the third guide hole and the fourth guide hole, and having a third coupling hole and a fourth coupling hole corresponding to the third guide hole and the fourth guide hole, wherein the upper coupling plate and the base plate are coupled by a first coupling bolt disposed through the first coupling hole and the first guide hole and a second coupling bolt disposed through the second coupling hole and the second guide hole, and the lower coupling plate and the base plate are coupled by a third coupling bolt disposed through the third coupling hole and the third guide hole and a fourth coupling bolt disposed through the fourth coupling hole and the fourth guide hole, wherein a first bending portion bending and extending horizontally toward the assembling portion and a first inserting portion bending and extending upward from an end of the first bending portion are disposed at an end over the first coupling hole of the upper coupling plate, wherein a second bending portion bending and extending horizontally toward the assembling portion and a second inserting portion bending and extending upward from an end of the second bending portion are disposed at an end over the second coupling hole of the upper coupling plate, wherein a third bending portion bending and extending horizontally toward the assembling portion and a third inserting portion bending and extending downward from an end of the third bending portion are disposed at an end under the third coupling hole of the lower coupling plate, wherein a fourth bending portion bending and extending horizontally toward the assembling portion and a fourth inserting portion bending and extending downward from an end of the fourth bending portion are disposed at an end under the fourth coupling hole of the lower coupling plate, and wherein the vertical post and the horizontal post are assembled by moving up the upper coupling plate and moving down the lower coupling plate with the first to fourth inserting portions inserted in the first to fourth insertion holes.

* * * * *